US011529643B2

(12) United States Patent
Karaki et al.

(10) Patent No.: US 11,529,643 B2
(45) Date of Patent: Dec. 20, 2022

(54) NOZZLE CLEANING APPARATUS

(71) Applicant: NHK SPRING CO., LTD., Yokohama (JP)

(72) Inventors: Shohji Karaki, Yokohama (JP); Mitsuo Urano, Yokohama (JP); Tomoya Osumi, Yokohama (JP); Shinpei Kakiuchi, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 516 days.

(21) Appl. No.: 16/779,786

(22) Filed: Feb. 3, 2020

(65) Prior Publication Data

US 2020/0298286 A1 Sep. 24, 2020

(30) Foreign Application Priority Data

Mar. 20, 2019 (JP) ..... JP2019-052261

(51) Int. Cl.
*B05B 15/55* (2018.01)
*B05B 15/555* (2018.01)

(52) U.S. Cl.
CPC ..... *B05B 15/55* (2018.02); *B05B 15/555* (2018.02)

(58) Field of Classification Search
CPC ..... B05B 15/50; B05B 15/55; B05B 15/555; B05B 15/60; B08B 3/10; B08B 13/00; B05C 11/10
See application file for complete search history.

(56) References Cited

U.S. PATENT DOCUMENTS 10,160,577 B2 12/2018 Decock et al.
2008/0023034 A1* 1/2008 Hirao ..... B05B 15/557 134/186
2010/0310757 A1* 12/2010 Ooshiro ..... B05B 12/08 118/668
2012/0279521 A1* 11/2012 Villarico ..... B05B 9/04 134/22.12

(Continued)

FOREIGN PATENT DOCUMENTS

CN 104107815 A 10/2014
CN 104941876 A 9/2015

(Continued)

OTHER PUBLICATIONS

Chinese Office Action (and English language translation thereof) dated Jan. 17, 2022, issued in counterpart Chinese Application No. 202010121572.0.

*Primary Examiner* — Darren W Gorman
(74) *Attorney, Agent, or Firm* — Holtz, Holtz & Volek PC

(57) ABSTRACT

A nozzle cleaning apparatus has one cleaning liquid outlet to which a nozzle is attached, and the other cleaning liquid outlet to which a cleaning attachment is attached. The cleaning attachment includes a nozzle cover, and a cleaning holder attached to the nozzle cover. A cleaning chamber is formed in the nozzle cover. A cleaning liquid inflow chamber, an outer cleaning liquid ejection port, and a cleaning liquid discharge hole are formed in the cleaning holder. A cleaning liquid ejected in a first direction from the nozzle and a cleaning liquid ejected in a second direction from the outer cleaning liquid ejection portion toward the nozzle collide with each other near discharge portions inside the cleaning chamber.

6 Claims, 8 Drawing Sheets

(56) References Cited

U.S. PATENT DOCUMENTS

| | | | | |
|---|---|---|---|---|
| 2016/0052028 | A1* | 2/2016 | Breault | B08B 9/021 15/316.1 |
| 2018/0214901 | A1* | 8/2018 | Nelson | B05C 21/00 |
| 2019/0076871 | A1* | 3/2019 | Hentschel | B05B 15/555 |
| 2021/0220879 | A1 | 7/2021 | Dunfee et al. | |

FOREIGN PATENT DOCUMENTS

| | | | |
|---|---|---|---|
| CN | 105057297 | A | 11/2015 |
| CN | 205851501 | U | 1/2017 |
| CN | 107214152 | A | 9/2017 |
| CN | 108067387 | A | 5/2018 |
| CN | 109070148 | A | 12/2018 |
| CN | 109201640 | A | 1/2019 |
| CN | 208555354 | U | 3/2019 |
| JP | 2010045094 | A | 2/2010 |
| JP | 2018079417 | A | 5/2018 |
| WO | 2015140473 | A1 | 9/2015 |

* cited by examiner

NOZZLE CLEANING APPARATUS

CROSS-REFERENCE TO RELATED APPLICATIONS

This application is based upon and claims the benefit of priority from prior Japanese Patent Application No. 2019-052261, filed Mar. 20, 2019, the entire contents of which are incorporated herein by reference.

BACKGROUND OF THE INVENTION

1. Field of the Invention

The present invention relates to a nozzle cleaning apparatus which cleans a nozzle which applies a discharge substance such as an adhesive to an application target object.

2. Description of the Related Art

In order to apply a discharge substance such as an adhesive to an application target object, an application apparatus (dispenser) having a nozzle is used in some cases. Examples of the discharge substance are an adhesive having viscosity and a conductive material in paste form. In order to apply such a discharge substance to an application target object, the discharge substance is pressurized and pushed out of the distal end opening of the nozzle. The pressure (application pressure) of the discharge substance at a time when the discharge substance is applied is set according to the viscosity of the discharge substance, and the like, and reaches several hundreds of kilopascals (KPa) in some cases.

After the nozzle is used, the nozzle is cleaned, and the discharge substance adhered to the nozzle is removed. It is necessary to carefully clean the discharge substance adhered to the inside of the nozzle and the distal end portion of the nozzle in particular. A cleaning apparatus which cleans the inside and the distal end portion of the nozzle is described in, for example, JP 2010-45094 A (Patent Literature 1) and JP 2018-79417 A (Patent Literature 2). In general, a conventional cleaning apparatus makes a pressurized cleaning liquid flow into the nozzle.

As an example of the application target object, a hard disk device (HDD) suspension used in an HDD is known. In order to apply a discharge substance to such a small application target object, a nozzle having a discharge hole of an inner diameter of 1 mm or less (for example, inner diameter φ0.1 to 0.16 mm) is used. In addition, the length of the discharge hole is relatively great as compared to the inner diameter of the discharge hole. In order to clean the inside of such a long and thin nozzle, a high-pressure cleaning liquid which is pressurized to several tens of megapascals (MPa) is supplied to the nozzle in some cases.

However, it is sometimes difficult to fully clean the nozzle even by high-pressure cleaning. In particular, it is difficult to remove the discharge substance adhered to the vicinity of the distal end opening of the nozzle simply by making the high-pressure cleaning liquid flow into the nozzle. Therefore, the discharge substance may be left adhered to the nozzle in some cases. It is not preferable to apply the discharge substance in a state where the discharge substance is adhered to the vicinity of the distal end of the nozzle because the application amount and the application shape become unstable.

In order to reliably clean the nozzle, the nozzle is manually cleaned using a cleaning tool such as a brush. However, such manual work is time consuming. In addition, high skill and experience are required for thoroughly cleaning the small nozzle. Depending on circumstances, the discharge substance may be left in the vicinity of the distal end opening of the nozzle. For such a reason, more improvements need to be made.

BRIEF SUMMARY OF THE INVENTION

Therefore, the present invention aims to provide a nozzle cleaning apparatus which can fully clean a nozzle and effectively remove a discharge substance adhered to the vicinity of a distal end opening of the nozzle in particular.

According to one embodiment, a nozzle cleaning apparatus includes a cleaning tank, one cleaning liquid outlet having a connection portion to which a nozzle to be cleaned can be attached, a cleaning liquid supply means which supplies a cleaning liquid to the cleaning liquid outlet, the other cleaning liquid outlet to which a cleaning liquid is supplied by the cleaning liquid supply means, and a cleaning attachment connected to the other cleaning liquid outlet. The cleaning attachment includes a nozzle holding portion in which a distal end portion of the nozzle attached to the one cleaning liquid outlet is inserted, an outer cleaning liquid ejection port, a cleaning chamber, and a cleaning liquid discharge hole which discharges the cleaning liquid which flows into the cleaning chamber.

The outer cleaning liquid ejection port faces the distal end portion of the nozzle inserted in the nozzle holding portion, and ejects the cleaning liquid supplied no the other cleaning liquid outlet toward the distal end portion of the nozzle. In a state where the distal end portion of the nozzle is inserted in the nozzle holding portion, a discharge portion of the nozzle is arranged in the cleaning chamber. The cleaning liquid ejected in a first direction from the nozzle and the cleaning liquid ejected in a second direction from the outer cleaning liquid ejection port collide with each other.

According to the nozzle cleaning apparatus of the present invention, the cleaning liquid (inner cleaning liquid) ejected in the first direction from the nozzle and the cleaning liquid (outer cleaning liquid) ejected in the second direction from the outer cleaning liquid ejection port toward the nozzle collide with each other in the vicinity of the distal end portion of the nozzle in the cleaning chamber. Consequently, the nozzle can be fully cleaned, and particularly, the vicinity of the distal end opening of the nozzle can be reliably cleaned.

The cleaning attachment may include a nozzle cover attached to the nozzle, a cleaning holder attached to the nozzle cover, a joint connected to the other cleaning liquid outlet, and a pipe. The nozzle cover has the nozzle holding portion and the cleaning chamber. The cleaning holder has a cleaning liquid inflow chamber which communicates with the outer cleaning liquid ejection port and the cleaning chamber. The pipe is provided between the joint and the outer cleaning liquid ejection port. The distal end portion of the nozzle, the cleaning chamber, and the outer cleaning liquid ejection port should preferably be arranged in a direction along an axis of the cleaning holder.

The cleaning holder may have the cleaning liquid discharge hole communicating with the cleaning liquid inflow chamber. The nozzle cleaning apparatus according to one embodiment may further include cleaning liquid outlets in addition to the one cleaning liquid outlet and the other cleaning liquid outlet. All the cleaning liquid outlets have the same shape. The nozzle cleaning apparatus according to one embodiment may further include plug members which close cleaning liquid outlets which are not used for cleaning among the cleaning liquid outlets. The cleaning tank may have a cleaning tank main body, and a lid which opens and closes an opening of the cleaning tank main body. All the cleaning liquid outlets may be disposed in the lid.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
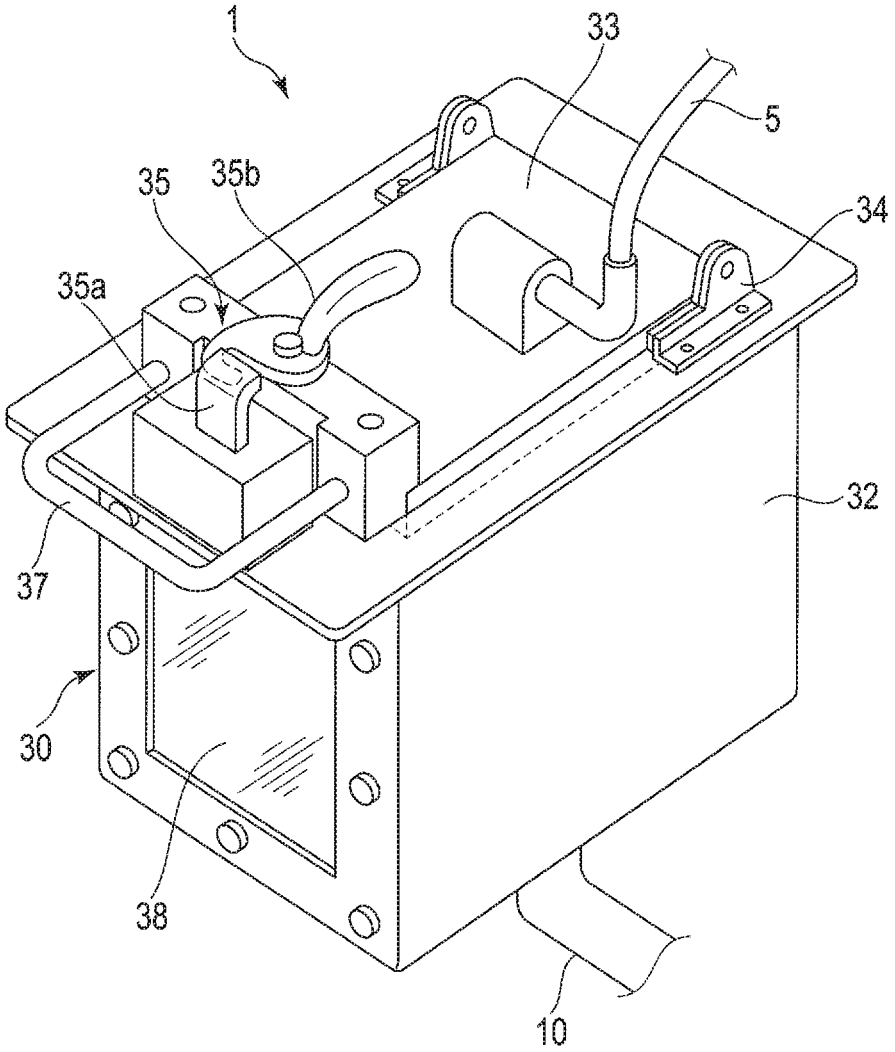
FIG. 1 is a perspective view of a nozzle cleaning apparatus according to one embodiment.
Figure 2:
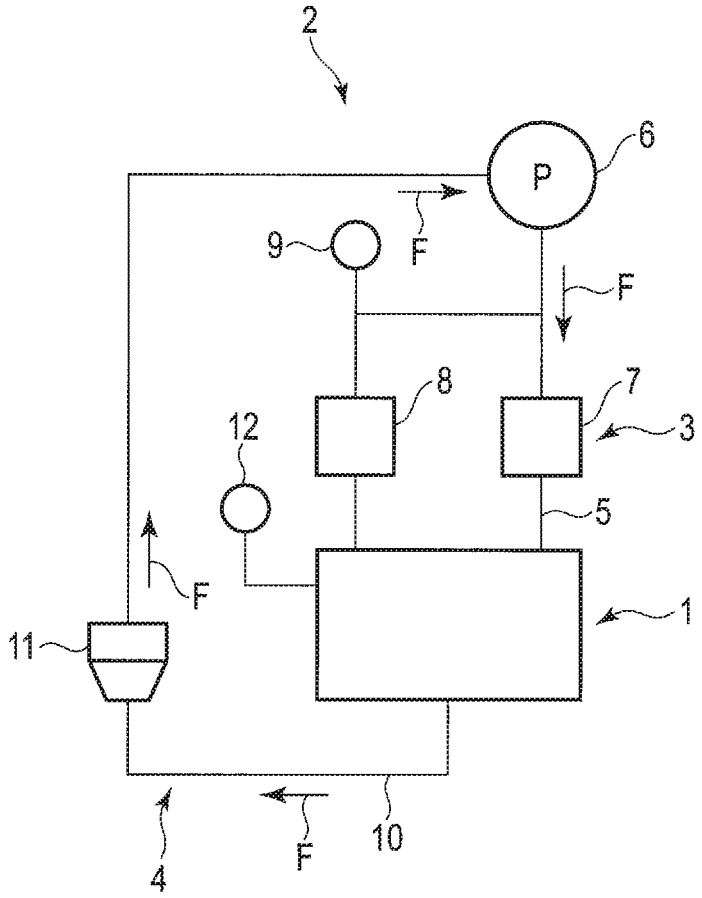
FIG. 2 is a block diagram of part of cleaning facilities including the nozzle cleaning apparatus shown in FIG. 1.

Cleaning facilities 2 including a nozzle apparatus 1 according to one embodiment will be described hereinafter with reference to FIGS. 1 to 9. FIG. 1 is a perspective view of the nozzle cleaning apparatus 1. FIG. 2 is a block diagram of part of the cleaning facilities 2 including the nozzle cleaning apparatus 1. The cleaning facilities 2 shown in FIG. 2 include a cleaning liquid supply system 3 and a cleaning liquid collection system 4. The cleaning liquid supply system 3 supplies a cleaning liquid to the nozzle cleaning apparatus 1. The cleaning liquid collection system 4 collects a cleaning liquid from the nozzle cleaning apparatus 1. Arrows F in FIG. 2 indicate the flow direction of the cleaning liquid.

The cleaning liquid supply system 3 includes a cleaning liquid supply pipe 5 which functions as a cleaning liquid supply means, a pump 6, a relief valve 7, an on/off valve 8, a pressure gage 9, and the like. The pump 6 supplies a cleaning liquid to the cleaning liquid supply pipe 5. The cleaning liquid supply pipe 5 is connected to the outlet of the pump 6. The cleaning liquid collection system 4 includes a cleaning liquid discharge pipe 10 which functions as a cleaning liquid discharge means, a filter 11 which filters a cleaning liquid, and the like. The cleaning liquid discharge pipe 10 is connected to the inlet of the pump 6. The pressure gage 12 may be disposed in the nozzle cleaning apparatus 1.

Figure 3:
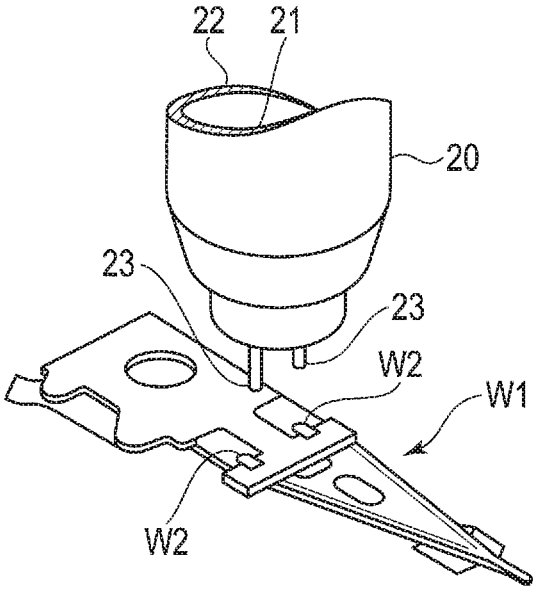
FIG. 3 is a perspective view showing an example of a nozzle and an application target object.

Although the nozzle to be cleaned is not limited to any particular type, for example, as shown in FIG. 3, the nozzle to be cleaned may be a nozzle 20 which applies a discharge substance such as an adhesive to application portions W2 of an application target object W1. The nozzle 20 forms part of an application apparatus (dispenser). The nozzle 20 has a nozzle body 22 having a pressure chamber 21, and pin-shaped discharge portions 23. The discharge portions 23 are disposed in the nozzle body 22. The number of discharge portions 23 may be one or may be two or more. The application target object W1 is, for example, a hard disk device (HDD) suspension used in an HDD.

As shown in FIG. 3, the discharge substance pushed out of each discharge portion 23 of the nozzle 20 is supplied to each application portion W2. The discharge substance is, for example, a conductive material in paste form (for example, a silver paste). As another example of the discharge substance, a liquid adhesive which has not been cured yet may be used. The pressure (application pressure) applied to the discharge substance at a time when the discharge substance is applied to the application target object is set according to the characteristics such as the viscosity of the discharge substance. The application pressure may reach, for example, a several hundreds of kilopascals (KPa).

Figure 4:
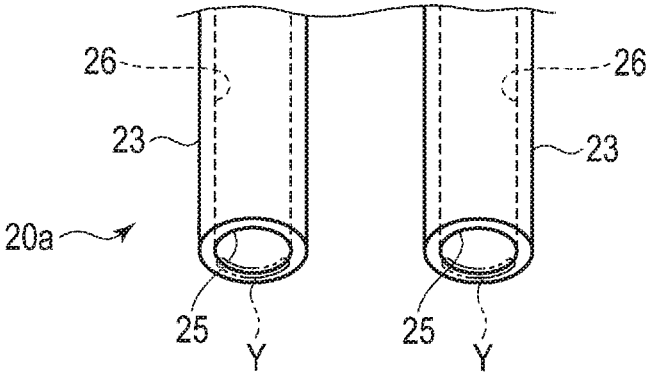
FIG. 4 is a perspective view of a distal end portion of the nozzle.

FIG. 4 shows the discharge portions 23 formed in a distal end portion 20*a* of the nozzle 20. A distal end opening 25 is formed at the distal end of each discharge portion 23. A discharge hole 26 is formed in each discharge portion 23. The discharge hole 26 communicates with the pressure chamber 21 of the nozzle body 22 and the distal end opening 25. The inner diameter of the discharge hole 26 can be arbitrarily determined and may be, for example, φ0.1 to 0.16 mm. The length of the discharge hole 26 may be ten times greater than the inner diameter of the discharge hole 26. The discharge substance is adhered to the nozzle 20 which has been used. Therefore, the nozzle 20 is cleaned by the nozzle cleaning apparatus 1 of the present embodiment.

Figure 5:
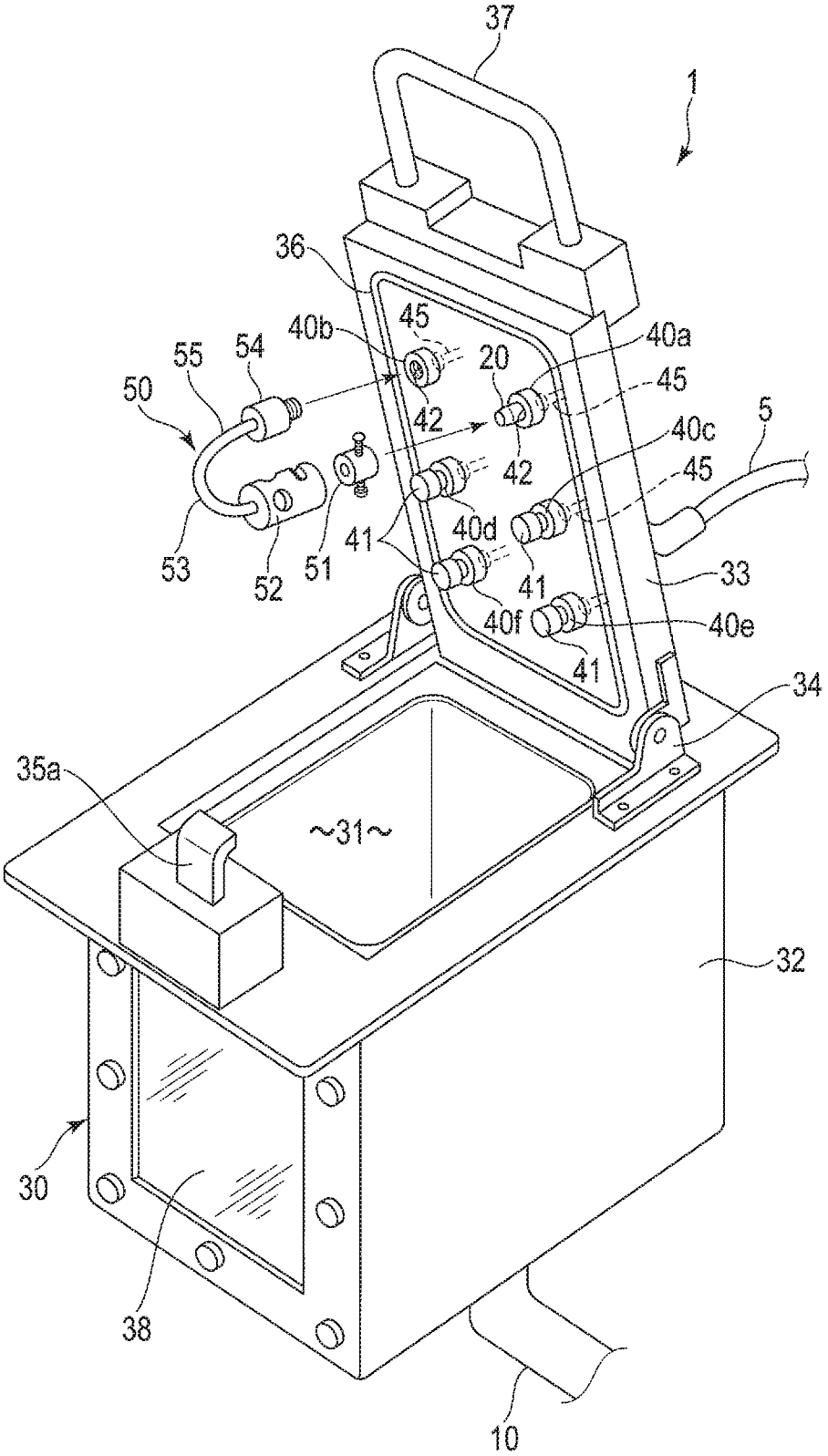
FIG. 5 is a perspective view showing a state where a lid of the nozzle cleaning apparatus shown in FIG. 1 is opened and a cleaning attachment has not been attached yet.
Figure 6:
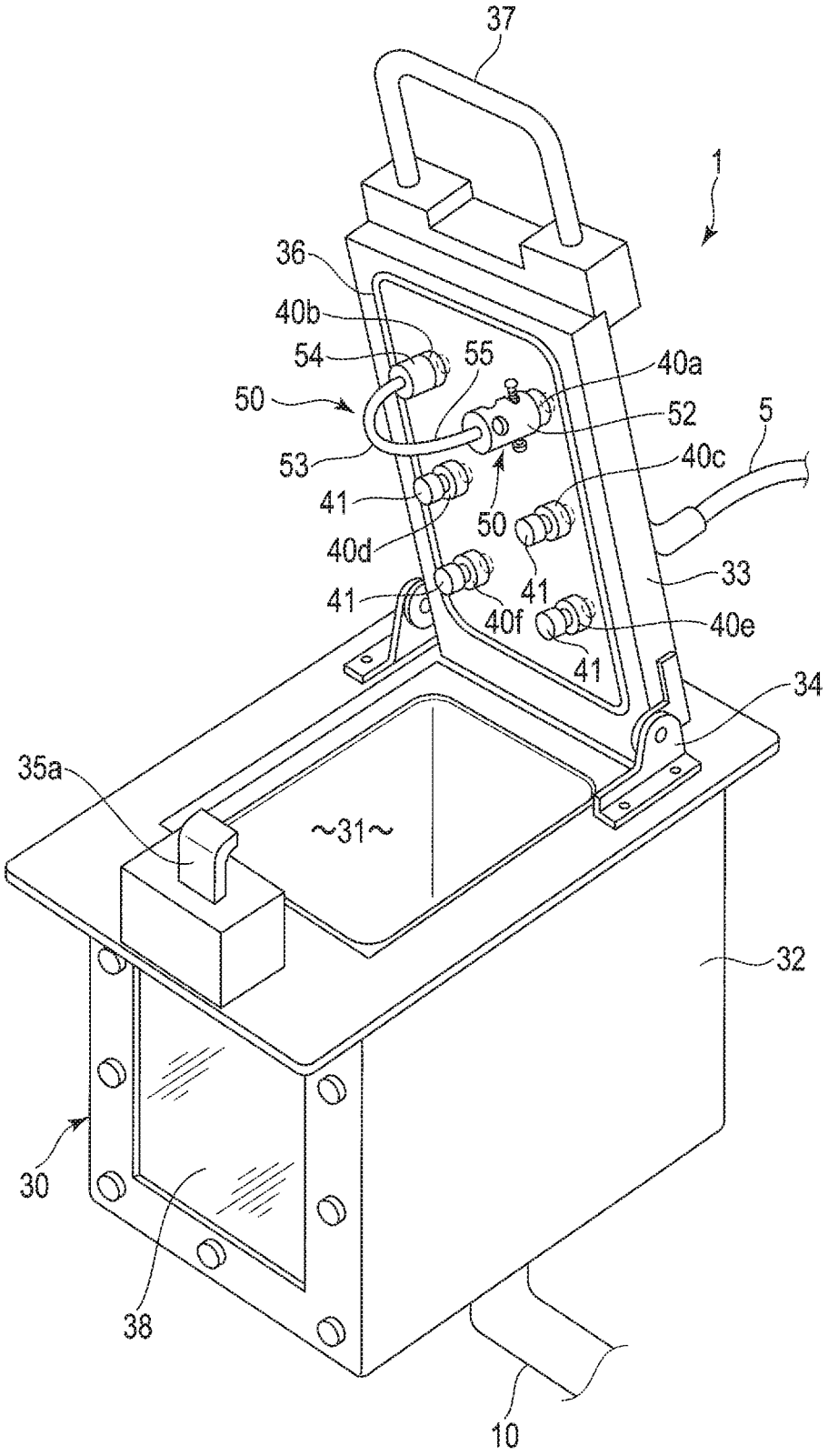
FIG. 6 is a perspective view showing a state where the cleaning attachment is attached to the nozzle cleaning apparatus shown in FIG. 5.

As shown in FIGS. 1, 5 and 6, the nozzle cleaning apparatus 1 has a cleaning tank 30. The cleaning tank 30 has a cleaning tank main body 32, a lid 33, hinge mechanisms 34 for the lid 33, and a clamp mechanism 35. The cleaning tank main body 32 has an opening 31 on its upper surface. The lid 33 can be turned upward and downward by the hinge mechanisms 34. The lid 33 can close the opening 31. A cleaning liquid discharge pipe 10 is connected to the bottom portion of the cleaning tank main body 32.

A seal member 36 such as an O-ring is disposed on the inner side of the lid 33. The seal member 36 seals the mating surface of the cleaning tank main body 32 and the mating surface of the lid 33. The lid 33 is provided with a handle 37. The worker can open and close the lid 33 using the handle 37. A window portion 38 for observation is formed on the front surface or the side surface of the cleaning tank main body 32. The window portion 38 is formed of an optically transparent material such that the worker can see the inside of the cleaning tank 30.

FIG. 1 shows a state where the lid 33 is closed. FIGS. 5 and 6 show a state where the lid 33 is opened. The clamp mechanism 35 has a bracket 35*a* and a clamp lever 35*b*. The bracket 35*a* is disposed in the cleaning tank main body 32. The clamp lever 35*b* is disposed in the lid 33. It is possible to fix the lid 33 in a close position by closing the lid 33, moving the clamp lever 35*b* to a lock position, and engaging the clamp lever 35*b* with the bracket 35*a*. It is possible to open the lid 33 by moving the clamp lever 35*b* to an unlock position.

As shown in FIGS. 5 and 6, a plurality of cleaning liquid outlets, for example, six cleaning liquid outlets 40*a* to 40*f* are disposed on the inner side of the lid 33. The cleaning liquid outlets 40*a* to 40*f* have the same shape. A connection portion 42 having a thread portion (internal thread) (only partly shown in FIG. 5) is formed in each of the cleaning liquid outlets 40*a* to 40*f*. The nozzle 20 can be attached to the thread portion of the connection portion 42. In addition, a plug member 41 can also be attached to the thread portion of the connection portion 42. Furthermore, a joint 54 of a cleaning attachment 50 can also be attached to the thread portion of the connection portion 42. The cleaning attachment 50 will be described later in detail.

A cleaning liquid distribution portion 45 communicating with the cleaning liquid outlets 40*a* to 40*f* (only partly shown in FIG. 5) is formed in the lid 33. A cleaning liquid supply pipe 5 is connected to the cleaning liquid distribution portion 45. A cleaning liquid is supplied to the cleaning liquid outlets 40*a* to 40*f* at substantially the same pressure via the cleaning liquid distribution portion 45. The cleaning liquid discharge pipe 10 is connected to the bottom portion of the cleaning tank main body 32. The cleaning liquid which has flown into the cleaning tank main body 32 is discharged to the outside of the cleaning tank main body 32 by the cleaning liquid discharge pipe 10.

The cleaning liquid outlets 40*a* to 40*f* have the same configuration. In the present specification, as shown in FIGS. 5 and 6, the case of cleaning the nozzle 20 using the first cleaning liquid outlet 40*a* and the second cleaning liquid outlet 40*b* among these six cleaning liquid outlets 40*a* to 40*f* will be described. For example, the nozzle 20 is attached to one cleaning liquid outlet 40*a*. The cleaning attachment 50 is attached to the other cleaning liquid outlet 40*b*. The cleaning liquid outlets 40*c* to 40*f* which are not used for cleaning are closed with the plug members 41 which can be attached and detached.

In the present specification, the case of cleaning the nozzle using the first cleaning liquid outlet 40*a* and the second cleaning liquid outlet 40*b* will be described. However, it is also possible to clean the nozzle using the cleaning liquid outlets 40*c* to 40*f* other than the cleaning liquid outlets 40*a* and 40*b*. In that case also, the nozzle is attached to one of the pair of cleaning liquid outlets, and the cleaning attachment 50 is attached to the other cleaning liquid outlet. The cleaning liquid outlets which are not used for cleaning are closed with the plug members 41.

The cleaning attachment 50 will be described below.

Figure 7:
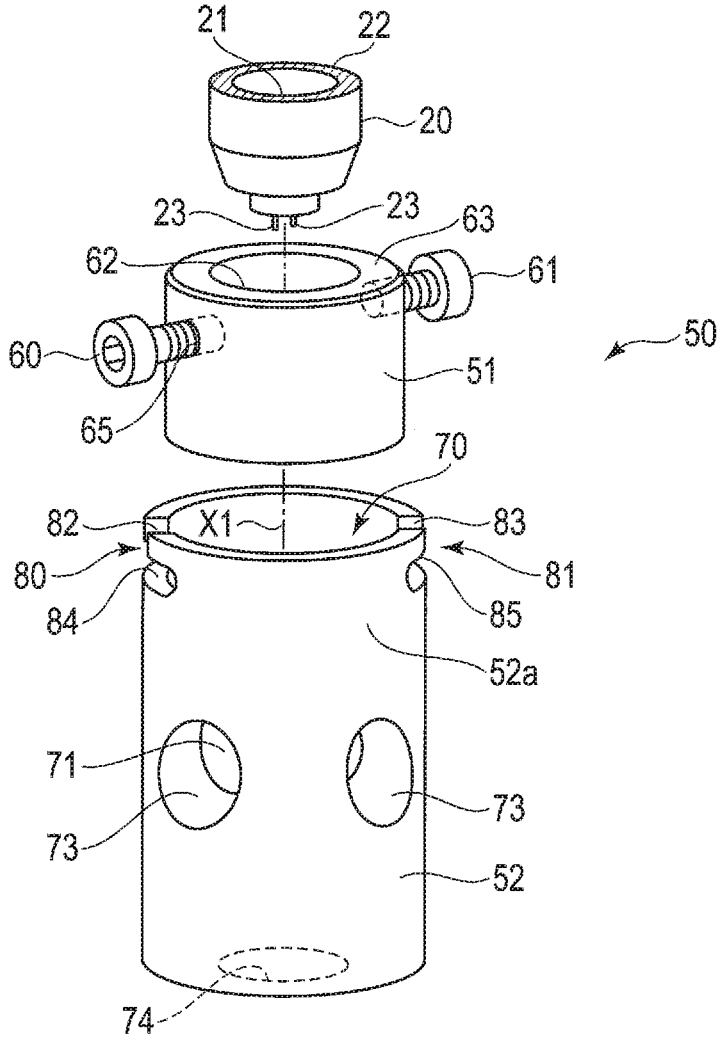
FIG. 7 is an exploded perspective view showing part of the cleaning attachment and part of the nozzle.
Figure 8:
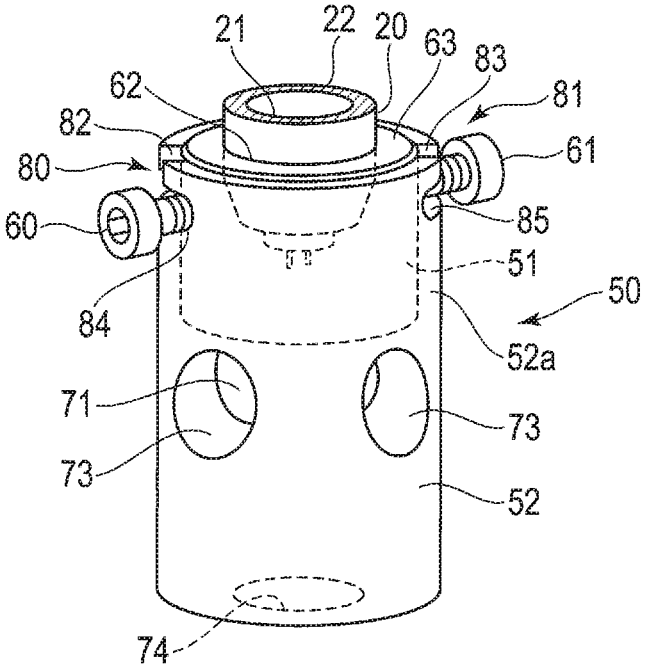
FIG. 8 is a perspective view showing a state where the cleaning attachment shown in FIG. 7 is attached to the nozzle.
Figure 9:
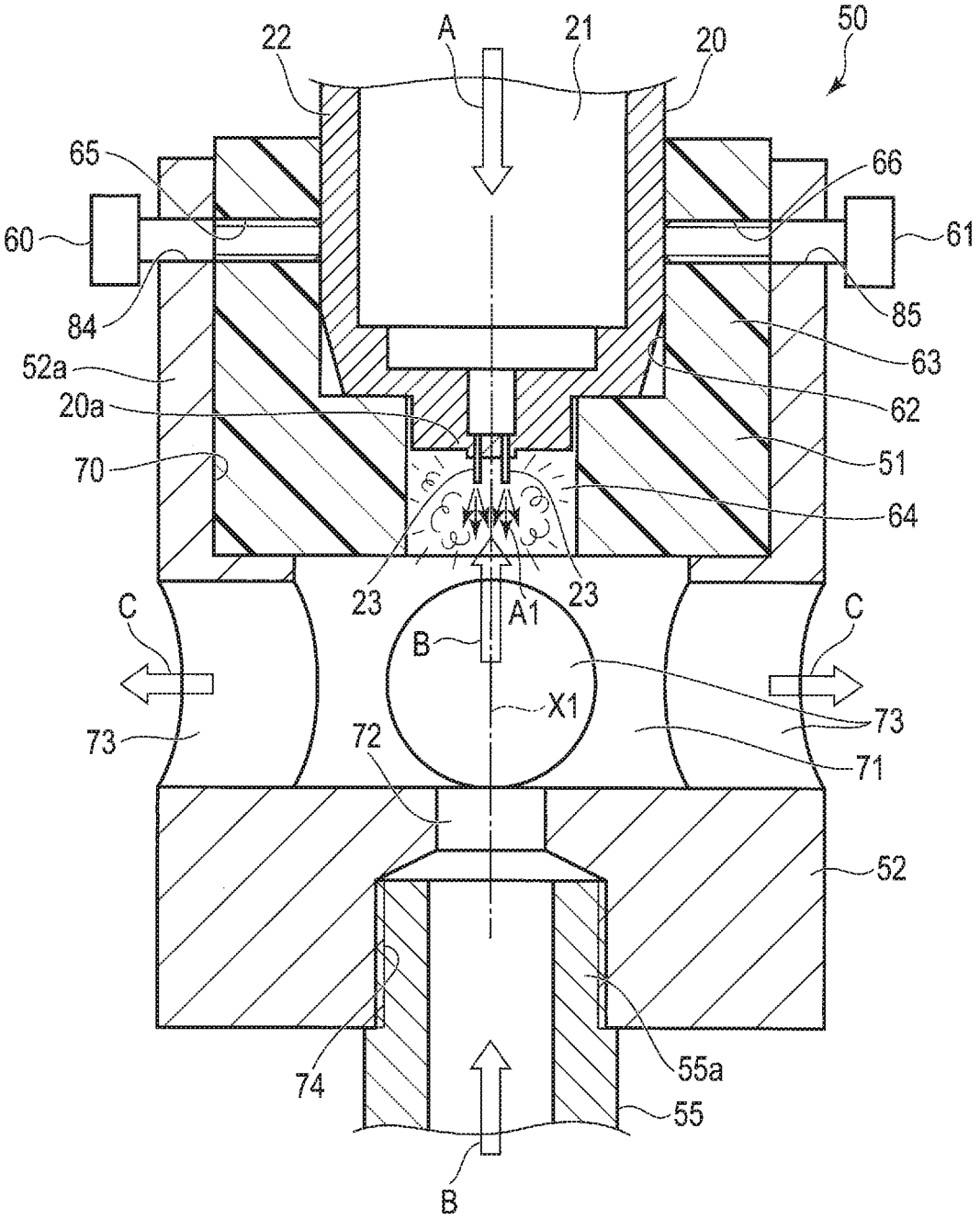
FIG. 9 is a cross-sectional view of the cleaning attachment and the nozzle shown in FIG. 8.

FIG. 7 is an exploded perspective view showing part of the nozzle 20 and the cleaning attachment 50. FIG. 8 is a perspective view showing a state where the cleaning attachment 50 is attached to the nozzle 20. FIG. 9 is a cross-sectional view of the nozzle 20 and the cleaning attachment 50 taken along an axis X1.

The cleaning attachment 50 includes a nozzle cover 51, a cleaning holder 52, and a connection member 53 (shown in FIGS. 5 and 6). The connection member 53 has the joint 54 which can be attached to and detached from the cleaning liquid outlets 40*a* to 40*f*, and a flexible pipe 55. The joint 54 can be attached to any one of the cleaning liquid outlets 40*a* to 40*f*. In the example shown in FIGS. 5 and 6, the joint 54 is connected to the first cleaning liquid outlet 40*a*. One end of the pipe 55 is connected to the cleaning holder 52. The other end of the pipe 55 is connected to the joint 54.

The nozzle cover 51 is, for example, a substantially cylindrical resin mold. The nozzle cover 51 has fixing members 60 and 61 used for fixing the nozzle cover 51 to the nozzle 20. The fixing members 60 and 61 are, for example, bolts, and project in the radial direction of the nozzle cover 51. The nozzle cover 51 has a nozzle holding portion 63 and a cleaning chamber 64. The nozzle holding portion. 63 has a nozzle insertion hole 62 in which the nozzle 20 is inserted. The discharge portions 23 of the nozzle 20 are accommodated in the cleaning chamber 64.

The fixing members 60 and 61 are rotated in such directions that the fixing members 60 and 61 are inserted in screw holes 65 and 66 of the nozzle cover 51, respectively. The distal ends of the fixing members 60 and 61 contact the outer peripheral surface of the nozzle 20. In this state, the fixing members 60 and 61 are further rotated in such directions that the fixing members 60 and 61 are further tightened. Consequently, the nozzle cover 51 is fixed to the nozzle 20. As shown in FIG. 9, when the distal end portion 20*a* of the nozzle 20 is inserted in the nozzle cover 51, the discharge portions 23 of the nozzle 20 are located in the cleaning chamber 64. In addition, the discharge portions 23 of the nozzle 20 project in a direction along the axis X1 of the cleaning holder 52.

The cleaning holder 52 has a substantially cylindrical shape. The cleaning holder 52 has a cylindrical portion 52*a*, a cleaning liquid inflow chamber 71 (shown in FIG. 9), an outer cleaning liquid ejection port 72, and a cleaning liquid discharge hole 73. The cylindrical portion 52*a* has a hole 70 in which the nozzle cover 51 is inserted. The cleaning liquid inflow chamber 71 communicates with the cleaning chamber 64. The outer cleaning liquid ejection port 72 communicates with the cleaning liquid inflow chamber 71. The cleaning liquid discharge hole 73 can discharge the cleaning liquid which has flown into the cleaning liquid inflow chamber 71 to the outside of the cleaning liquid inflow chamber 71. The outer cleaning liquid ejection port 72 is connected to one end of the pipe 55 of the cleaning attachment 50 via a connection port 74 having an internal thread portion. The distal end portion 20*a* of the nozzle 20, the cleaning chamber 64, and the outer cleaning liquid ejection port 72 are arranged in a direction along the axis X1 of the cleaning holder 52.

Fitting portions 80 and 81 which can be engaged with the fixing members 60 and 61 are formed in the cylindrical portion 52*a* of the cleaning holder 52. The fitting portions 80 and 81 are used for fixing the cleaning holder 52 to the nozzle cover 51. For example, the fitting portions 80 and 81 have first groove portions 82 and 83, respectively, and second groove portions 84 and 85, respectively. The first groove portions 82 and 83 extend in a direction along the axis X1 of the cleaning holder 52. The second groove portions 84 and 85 extend in the circumferential direction of the cleaning holder 52.

The cleaning holder 52 is fixed to the nozzle cover 51. When the cleaning holder 52 is fixed to the nozzle cover 51, the fixing members 60 and 61 are inserted in the first groove portions 82 and 83, respectively. Then, as the cleaning holder 52 is slightly rotated, the fixing members 60 and 61 are inserted in the second groove portions 84, and 85, respectively. Consequently, the fixing members 60 and 61 are prevented from moving in a direction along the axis X1 of the cleaning holder 52. That is, the detachment of the cleaning holder 52 from the nozzle cover 51 is prevented.

FIG. 9 shows a state where the nozzle cover 51 is inserted in the hole 70 of the cylindrical portion 52*a* of the cleaning holder 52. The distal end portion 20*a* of the nozzle 20, the cleaning chamber 64, the cleaning liquid inflow chamber 71, and the outer cleaning liquid ejection port 72 are located on the axis X1 of the cleaning holder 52. Therefore, a cleaning liquid ejected in a first direction A1 from the discharge portions 23 of the nozzle 20 passes through the cleaning chamber 64 and heads toward the cleaning liquid inflow chamber 71. On the other hand, a cleaning liquid ejected in a second direction B from the outer cleaning liquid ejection port 72 passes through the cleaning liquid inflow chamber 71 and heads toward the discharge portions 23 of the nozzle 20.

The function of the cleaning facilities 2 comprising the nozzle cleaning apparatus 1 of the present embodiment will be described below.

As shown in FIG. 5, the lid 33 of the cleaning tank 30 is opened. On the inner side of the lid 33, the cleaning liquid outlets 40*a* to 40*f* having the same shape are disposed. The nozzle 20 is attached to, for example, the first cleaning liquid outlet 40*a* of these cleaning liquid outlets 40*a* to 40*f*. The joint 54 of the cleaning attachment 50 is connected to the second cleaning liquid outlet 40*b*. The cleaning liquid outlets 40*c* to 40*f* which are not used for cleaning are closed with the plug members 41. Note that the joint 54 of the cleaning attachment 50 may be attached to the first cleaning liquid outlet 40*a* and the nozzle 20 may be attached to the second cleaning out 40*b* instead.

The nozzle can be cleaned using the first cleaning liquid outlet 40*a* and the second cleaning liquid outlet 40*b*. However, the nozzle can also be cleaned using the cleaning liquid outlets 40*c* to 40*f* other than the cleaning liquid outlets 40*a* and 40*b*. For example, the nozzle may be attached to the third clearing liquid outlet 40*c*, and the cleaning attachment 50 may be attached to the fourth cleaning liquid outlet 40*d*. Alternatively, the nozzle may be attached to the fifth cleaning liquid outlet 40*e*, and the cleaning attachment 50 may be attached to the sixth cleaning liquid outlet 40*f*.

As described above, the nozzle clearing apparatus 1 of the present embodiment can clean a maximum of three nozzles using sixth cleaning liquid outlets 40*a* to 40*f*. If the number of cleaning liquid outlets is an even number, the number of nozzles which can be cleaned is half of the number of cleaning liquid outlets. Note that the number of cleaning liquid outlets may be an odd number. A cleaning liquid outlet which is not used for cleaning is closed with the plug member 41.

In the example shown in FIG. 6, the nozzle 20 is attached to the first cleaning liquid outlet 40*a* of the cleaning liquid outlets 40*a* to 40*f*. The joint 54 of the cleaning attachment 50 is connected to the second cleaning liquid outlet 40*b*. The cleaning liquid outlets 40*c* to 40*f* which are not used for cleaning are closed with the plug members 41.

As shown in FIG. 1, the lid 33 of the cleaning tank 30 is closed, and the clamp lever 35*b* of the clamp mechanism 35 is moved to the lock position. Consequently, the lid 33 is fixed to the cleaning tank main body 32. In this state, a cleaning liquid which is pressurized by the pump 6 (shown in FIG. 2) is supplied to the cleaning liquid supply pipe 5. The cleaning liquid from the pump 6 is supplied to one cleaning liquid outlet 40*a* and the other cleaning liquid outlet 40*b*. The pressure of the cleaning liquid supplied by the pump 6 is several megapascals (MPa) (for example, 2 to 4 MPa) to several tens of megapascals (MPa) (for example, 20 to 40 MPa).

The cleaning liquid supplied from the cleaning liquid supply pipe 5 to one cleaning liquid outlet 40*a* enters the nozzle 20 as indicated by an arrow A in FIG. 9. The cleaning liquid which has entered the nozzle 20 passes through the discharge holes 26 of the nozzle 20 (shown in FIG. 4) and heads toward the discharge portions 23. The cleaning liquid which has entered each discharge portion 23 is ejected in the first direction A1 from the distal end opening 25 of each discharge portion 23 (shown in FIG. 4) toward the cleaning chamber 64. At this time, a discharge substance adhered to the inner surface of each discharge hole 26 is washed away by the cleaning liquid flowing in each discharge hole 26.

On the other hand, the cleaning liquid supplied from the cleaning liquid supply pipe 5 to the other cleaning liquid outlet 40*b* passes through the pipe 55 of the cleaning attachment 50 and heads toward the cleaning holder 52. The cleaning liquid which has reached the cleaning holder 52 is ejected in the second direction B from the outer cleaning liquid ejection port 72 toward the discharge portions 23 of the nozzle 20 as indicated by an arrow B in FIG. 9. The second direction B is opposite to the first direction A1. Therefore, the cleaning liquid ejected in the first direction A1 from the nozzle 20 and the cleaning liquid ejected in the second direction B from the outer cleaning liquid ejection port 72 heavily collide with each other in the cleaning chamber 64. The heavy collision of the cleaning liquid in the vicinity of the discharge portions 23 causes a strong tide and a turbulent flow of the cleaning liquid inside the cleaning chamber 64. A large number of fine bubbles are mixed into the colliding cleaning liquid, and these bubbles promote the cleaning function in some cases.

It has been difficult to fully clean the nozzle 20 simply by making the cleaning liquid flow into the nozzle 20 as a conventional cleaning apparatus. For example, a discharge substance (indicated by a dash-dot-dot line Y in FIG. 4) has been left in the vicinity of the distal end opening 25 of each discharge portion 23 in some cases. On the other hand, according to the nozzle cleaning apparatus 1 of the present embodiment, the cleaning liquid heavily collides in the vicinity of the discharge portions 23 arranged in the cleaning chamber 24. As the discharge portions 23 are exposed to the heavily colliding cleaning liquid, the discharge portions 23 can be effectively cleaned. In particular, the discharge substance adhered to the vicinity of the distal end opening 25 of each discharge portion 23 can be reliably removed, and the nozzle 20 can be fully cleaned.

As shown in FIG. 9, the cleaning liquid ejected from the nozzle 20 and the cleaning liquid ejected from the outer cleaning liquid ejection port 72 flow into the cleaning liquid inflow chamber 71. The cleaning liquid which has flown into the cleaning liquid inflow chamber 71 is guided from the cleaning liquid inflow chamber 71 to the cleaning liquid discharge hole 73 and is discharged to the outside of the cleaning holder 52 as indicated by an arrow C in FIG. 9. The cleaning liquid discharged from the cleaning holder 52 flows into the bottom portion of the cleaning tank 30. The cleaning liquid which has reached the bottom portion of the cleaning tank 30 passes through the cleaning liquid discharge pipe 10 and heads toward the filter 11. The cleaning liquid filtered by the filter 11 is resupplied again to the nozzle cleaning apparatus 1 by the pump 6. As the cleaning liquid circulates between the nozzle cleaning apparatus 1 and the pump 6, the nozzle 20 is cleaned.

Depending on the type of nozzle or the type of discharge substance, it may be possible to fully clean the nozzle simply by making the cleaning liquid flow into the nozzle. In that case, it is only necessary to eject the cleaning liquid from the nozzle simply by attaching the nozzle to any one of the cleaning liquid outlets 40*a* to 40*f* without using the cleaning attachment 50.

Needless to say, when the present invention is implemented, specific forms of the cleaning tank and the cleaning attachment constituting the nozzle cleaning apparatus as well as the cleaning liquid supply system and the cleaning liquid collection system can be variously modified as needed. The nozzle cleaning apparatus according to the present invention can be used for cleaning nozzles of various forms.

The nozzle cover and the cleaning holder constituting the cleaning attachment may be integrated into one component. In addition, at least one pair of cleaning liquid outlets (a cleaning liquid outlet to which the nozzle is attached and a cleaning liquid outlet to which the cleaning attachment is attached) may be disposed in a member other than the lid, for example, the cleaning tank main body or an auxiliary member.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A nozzle cleaning apparatus comprising:

a cleaning tank;

a first cleaning liquid outlet having a connection portion to which a nozzle to be cleaned can be attached;

a cleaning liquid supply means which supplies a cleaning liquid to the first cleaning liquid outlet;

a second cleaning liquid outlet to which a cleaning liquid is supplied by the cleaning liquid supply means; and a cleaning attachment connected to the second cleaning liquid outlet, wherein the cleaning attachment comprises:

a nozzle holding portion in which a distal end portion of the nozzle attached to the first cleaning liquid outlet is inserted;

an outer cleaning liquid ejection port which faces the distal end portion of the nozzle inserted in the nozzle holding portion and ejects the cleaning liquid supplied to the second cleaning liquid outlet toward the distal end portion of the nozzle;

a cleaning chamber in which the cleaning liquid ejected in a first direction from the nozzle and the cleaning liquid ejected in a second direction from the outer cleaning liquid ejection port collide with each other in a state where the distal end portion of the nozzle is inserted in the nozzle holding portion; and a cleaning liquid discharge hole which discharges the cleaning liquid which flows into the cleaning chamber.

2. The nozzle cleaning apparatus of claim 1, wherein the cleaning attachment further comprises:

a nozzle cover having the nozzle holding portion and the cleaning chamber, and attached to the nozzle;

a cleaning holder having a cleaning liquid inflow chamber which communicates with the outer cleaning liquid ejection port and the cleaning chamber, said cleaning holder being attached to the nozzle cover;

a joint connected to the second cleaning liquid outlet; and a pipe provided between the joint and the outer cleaning liquid ejection port.

3. The nozzle cleaning apparatus of claim 2, wherein the distal end portion of the nozzle, the cleaning chamber, and the outer cleaning liquid ejection port are arranged in a direction along an axis of the cleaning holder.

4. The nozzle cleaning apparatus of claim 2, wherein the cleaning holder has the cleaning liquid discharge hole communicating with the cleaning liquid inflow chamber.

5. The nozzle cleaning apparatus of claim 1, further comprising:

additional cleaning liquid outlets in addition to the first cleaning liquid outlet and the second cleaning liquid outlet, wherein all of the cleaning liquid outlets have a same shape; and plug members which close cleaning liquid outlets which are not used for cleaning among all of the cleaning liquid outlets.

6. The nozzle cleaning apparatus of claim 5, wherein:

the cleaning tank has a cleaning tank main body and a lid which opens and closes an opening of the cleaning tank main body, and all of the cleaning liquid outlets are disposed in the lid.

* * * * *